US007308861B2

(12) United States Patent
Cho

(10) Patent No.: US 7,308,861 B2
(45) Date of Patent: Dec. 18, 2007

(54) MANUFACTURING METHOD OF EMBROIDERY HAVING A PILE STRUCTURE

(75) Inventor: Byoung-Woo Cho, Yongin (KR)

(73) Assignee: Yupoong, Inc., Seoul (KR)

( * ) Notice: Subject to any disclaimer, the term of this patent is extended or adjusted under 35 U.S.C. 154(b) by 572 days.

(21) Appl. No.: 10/896,023

(22) Filed: Jul. 22, 2004

(65) Prior Publication Data

US 2006/0030757 A1 Feb. 9, 2006

(51) Int. Cl.
*D05C 15/00* (2006.01)
*D05C 17/00* (2006.01)

(52) U.S. Cl. ..... 112/475.23

(58) Field of Classification Search ..... 112/475.18, 112/475.22, 475.23, 78, 80.3, 80.7, 439, 410–415; 28/164

See application file for complete search history.

(56) References Cited

U.S. PATENT DOCUMENTS 735,575 A * 8/1903 Pauly ..... 112/475.23
1,096,302 A * 5/1914 Heymann ..... 112/9
3,444,017 A * 5/1969 Kleinermanns ..... 156/72
5,423,928 A * 6/1995 Hambright ..... 156/72
6,718,895 B1 * 4/2004 Fortuna ..... 112/475.19
6,994,044 B2 * 2/2006 Kwon ..... 112/475.18

FOREIGN PATENT DOCUMENTS

KR 20-339540 1/2004

* cited by examiner

*Primary Examiner*—Ismael Izaguirre
(74) *Attorney, Agent, or Firm*—Staas & Halsey LLP

(57) ABSTRACT

A manufacturing method of embroidery having a pile structure which may be performed by a general embroidering machine is disclosed. The method is accomplished by providing a base fabric, a first sheet having a predetermined thickness, and a second sheet in order, and embroidering a predetermined pattern on the base fabric together with the first and second sheet. An adhesive is applied over the back surface of the base fabric to fix the threads, and then the threads are cut over the first sheet. Finally, the first sheet and the second sheet are removed from the base fabric to form the resultant embroidery having a pile structure.

4 Claims, 12 Drawing Sheets

MANUFACTURING METHOD OF EMBROIDERY HAVING A PILE STRUCTURE

BACKGROUND OF THE INVENTION (a) Field of the Invention

The present invention relates to a manufacturing method of embroidery, and more particularly to a manufacturing method of embroidery having a pile structure.

(b) Description of the Related Art

A conventional method of manufacturing embroidery having a pile structure which is referred to as peached embroidery is disclosed in Korean Utility Model Publication No. 20-0339540. The conventional method needs a special embroidery machine having a cutter which cuts each thread after each needling as shown in the above publication. Referring to FIG. 4, the conventional method is as follows: First, a woven fabric 3 and a polyurethane sheet 2 with a predetermined thickness are provided on a main fabric 1. The special embroidery machine is constructed having a cutter 6 with respect to each needle, so that a thread is passed through the main fabric 1, woven fabric 3, and the polyurethane sheet 2 by a needle to be embroidered, and is then cut by the cutter 6 right after each needling in step (a). Next, the woven fabric 3 is removed. The piles have non-uniform heights as show in step (b), so they are then cut again by a cutter 9 over the polyurethane sheet 2 in step (c) in order to have a uniform pile height. After the second cutting, the polyurethane sheet 2 is removed and then an adhesive 7 is applied to the back of the main fabric 1 to fix the embroidered threads 4 in steps (d)-(e). However, the special embroidery machine to manufacture embroidery having a pile structure is very expensive, so it may increase product cost. Further, two steps of the cutting processes are required which increases the number of steps and the complexity of the method, resulting in low productivity and high product cost.

SUMMARY OF THE INVENTION

In view of the prior art described above, it is an object of the present invention to provide a manufacturing method of embroidery having a pile structure using a general embroidery machine.

It is another object of the present invention to provide a manufacturing method of embroidery having a pile structure which has simple processes to reduce product cost and improve productivity of the method.

To achieve these and other objects, as embodied and broadly described herein, a manufacturing method of embroidery having a pile structure includes:

preparing a base fabric having a front surface and a back surface;

providing a first sheet having a predetermined thickness on the front surface of the base fabric;

providing a second sheet on the first sheet;

embroidering a predetermined pattern on the base fabric together with the first and second sheet using a general embroidery machine, the second sheet preventing needles and threads of the embroidery machine from destroying the first sheet during the embroidering;

applying an adhesive over the back surface of the base fabric to fix the threads which lie over the back surface of the base fabric;

cutting threads over the first sheet; and removing the first sheet and the second sheet from the base fabric.

The first sheet is made of soft or semi-rigid material and is preferably Ethylene Vinyl Acetate (EVA). The second sheet is not destroyed by the repeated penetration of the needles and threads during the embroidering. The second sheet is preferably selected from non-woven fabric, woven fabric, and knitted fabric.

A third sheet may be disposed between the front surface of the base fabric and the first sheet before the embroidering. The third sheet accommodates the removal of the first and second sheets. The third sheet is similar to the second sheet.

The manufacturing method may be repeated in order to accomplish embroidery having a plurality of pile structures which have different pile heights.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 3*f*-3*l* illustrate steps of a manufacturing method of embroidery having a pile structure according to a third embodiment of the present invention.

DETAILED DESCRIPTION OF THE PREFERRED EMBODIMENTS

Figure 1A:
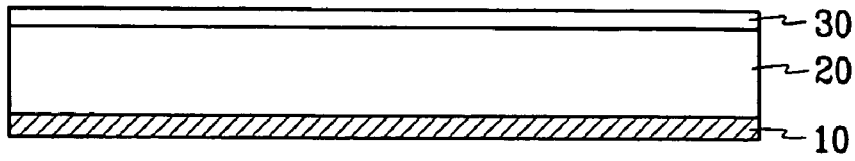
FIGS. 1*a*-1*f* illustrate steps of a manufacturing method of embroidery having a pile structure according to a first embodiment of the present invention.

Preferred embodiments of the present invention will hereinafter be described in detail with reference to the accompanying drawings, where like reference numerals designate like elements throughout.

Figure 1B:
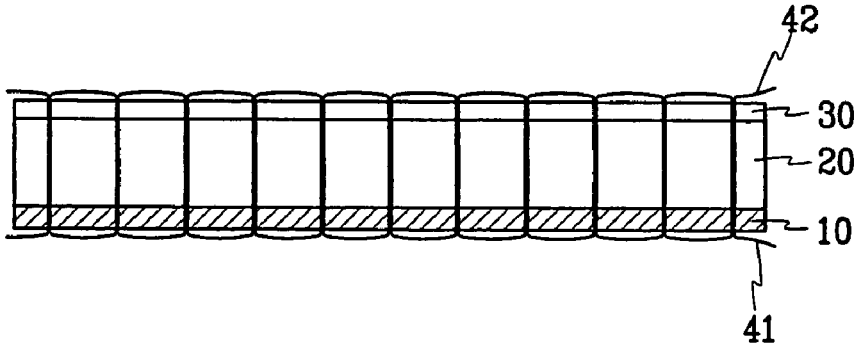
Figure 1C:
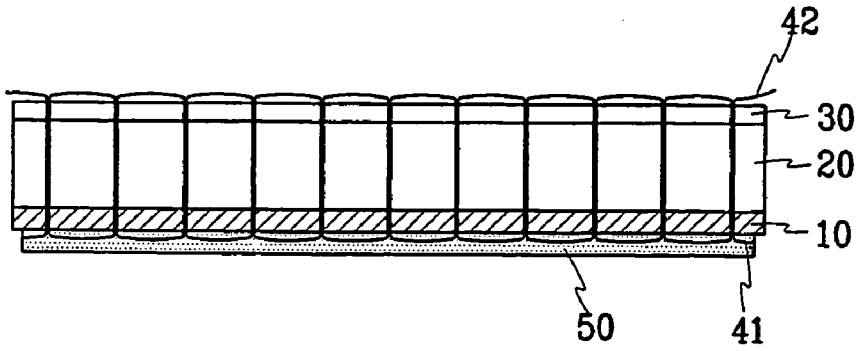
Figure 1D:
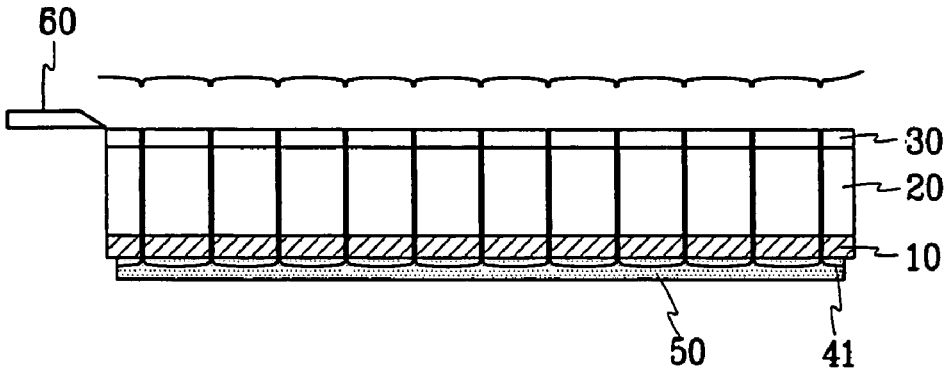
Figure 1E:
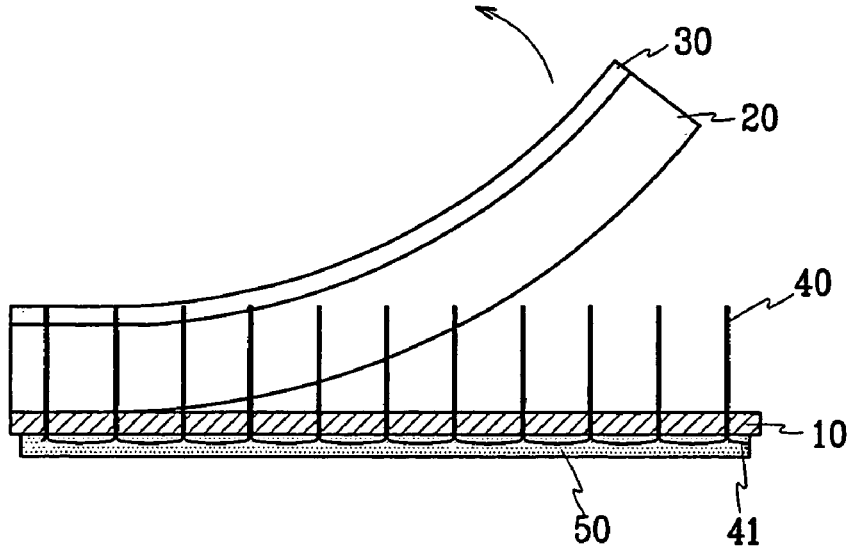
Figure 1F:
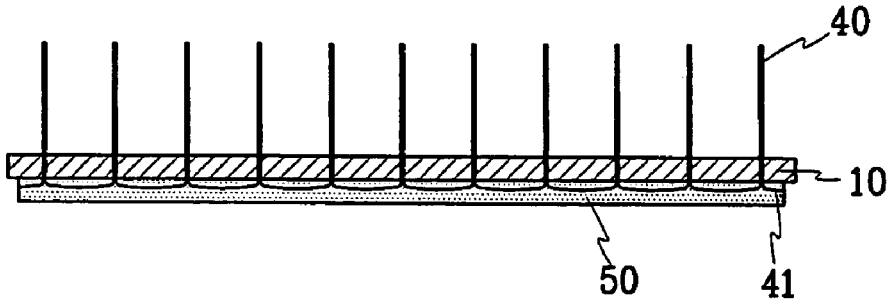

Referring to FIG. 1, a manufacturing method of embroidery having a pile structure according to a first embodiment of the present invention will be described. The method has an advantage in that it may be performed by a general embroidery machine which is well known, so a detailed description thereof will be omitted herein.

Creation of embroidery having a pile structure begins by placing an elastic sheet 20 and an upper sheet 30 on a front surface of a base fabric 10 on which the resultant embroidery is formed, as shown in step (a). Then, the non-woven sheet 30, the elastic sheet 20, and the base fabric 10 are embroidered in a predetermined pattern with an upper thread 42 and a bobbin thread 41 of the general embroidery machine in step (b).

The elastic sheet 20 is preferably made of soft or semi-rigid material such as Ethylene Vinyl Acetate (EVA) and has a predetermined thickness, allowing the embroidery pile to have a height which is substantially identical to the thickness thereof. Since the height of the pile is adjusted by the thickness of the elastic sheet 20, the resultant embroidery may have various pile heights.

The upper sheet 30 may prevent needles of the general embroidery machine from destroying the elastic sheet 20 during the embroidering step (b). When the elastic sheet 20 is destroyed by numerous penetrations of the needles and threads, it is difficult to remove the elastic sheet cleanly as fragments of the elastic sheet 20 may be left in the resultant embroidery. The upper sheet 30 is not limited to a specific material, but may be a non-woven fabric, a woven fabric, or a knitted fabric of which structure is not destroyed by the repeated penetration of the needles and threads during the embroidering step (b).

After the embroidering step (b), an adhesive 50 is applied on the back surface of the base fabric 10 to fix the upper thread 42 in step (c). Then, the upper thread 42 is cut over the upper sheet 30 by a suitable cutter 60 in step (d). A part of upper thread 42 and all the bobbin thread 41 are removed.

Next, the elastic sheet 20 and the upper sheet 30 are removed in step (e), and then embroidery 40 having a pile structure is completed in step (f).

The method according to the first embodiment has only one cutting step (d) to simplify the entire process. Further, a special embroidery machine is not required to form embroidery having a pile structure. The method is applicable to a plane surface in a fabric as well as a curved surface in various articles after the articles are completed. For examples, the method may apply directly to a crown of a cap.

Figure 2A:
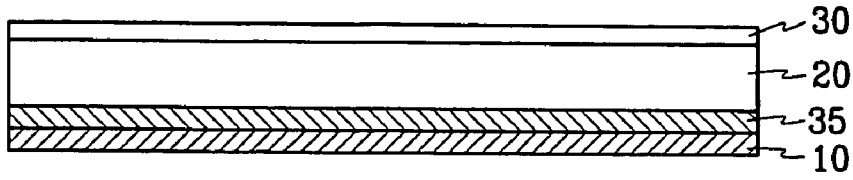
FIGS. 2*a*-2*f* illustrate steps of a manufacturing method of embroidery having a pile structure according to a second embodiment of the present invention.
Figure 2B:
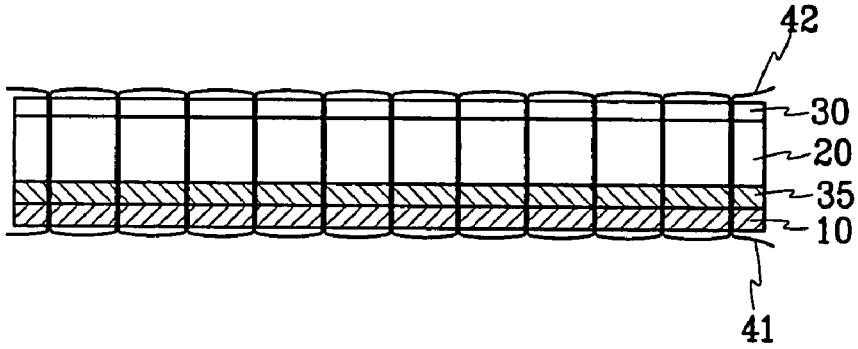
Figure 2C:
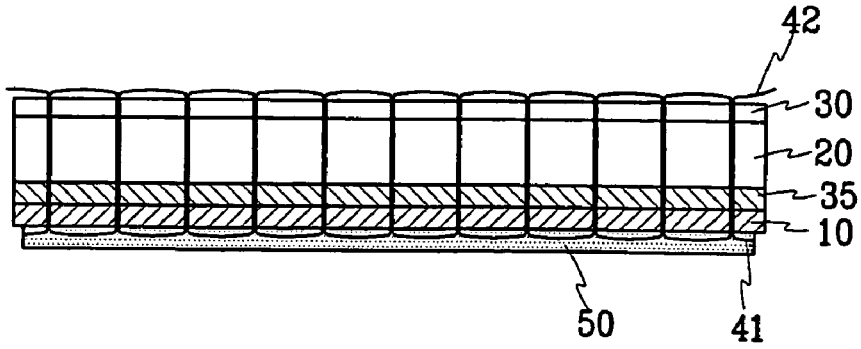
Figure 2D:
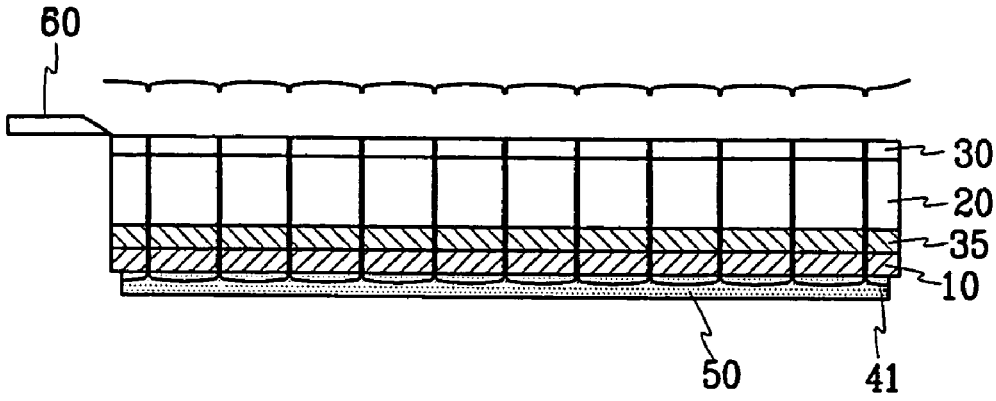
Figure 2E:
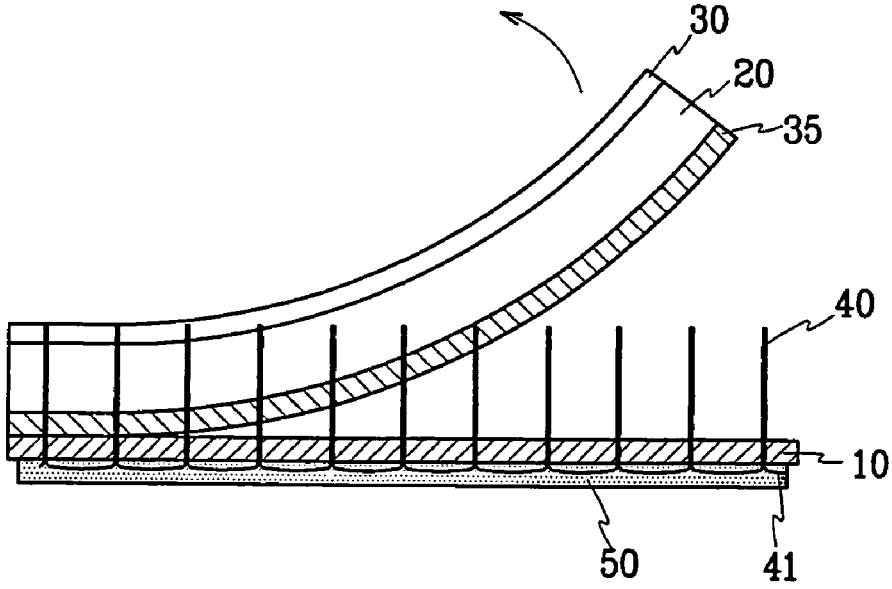
Figure 2F:
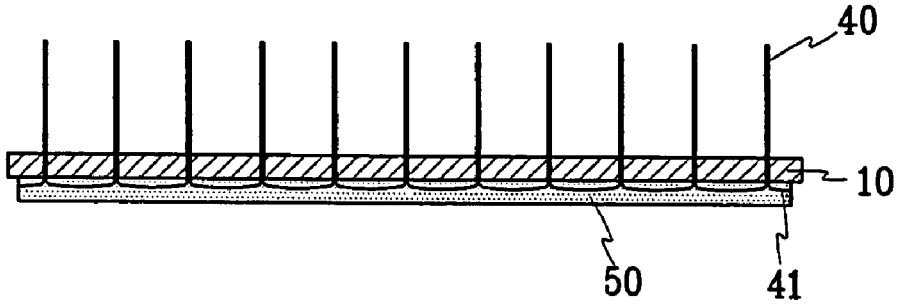

FIG. 2 is a diagram which illustrates a manufacturing method of embroidery having a pile structure according to a second embodiment of the present invention. The method of the second embodiment is similar to that of the first embodiment, with the exception of the use of a lower sheet 35 between a base fabric 10 and an elastic sheet 20.

The lower sheet 35 is placed on a front surface of the base fabric 10, and then the elastic sheet and an upper sheet 30 is provided thereon in step (a) as shown in FIG. 2.

The lower sheet 35 may accommodate the removal of the elastic sheet 20 and the upper sheet 30. The sheets 30 and 35 are not limited to a specific material, but may be a non-woven fabric, a woven fabric, or a knitted fabric sheet of which structure is not destroyed by the repeated penetration of the needles and threads during the following embroidering step (b).

Then, the upper sheet 30, the elastic sheet 20, the lower sheet 35, and the base fabric 10 are embroidered in a predetermined pattern with an upper thread 42 and a bobbin thread 41 of the general embroidery machine in step (b).

After the embroidering step (b), an adhesive 50 is applied on the back surface of the base fabric 10 to fix the upper thread 42 in step (c). Then, the upper thread 42 is cut over the upper sheet 30 by a suitable cutter 60 in step (d). A part of upper thread 42 and the bobbin thread 41 are removed.

Next, the lower sheet 35, the elastic sheet 20 and the upper sheet 30 are removed in step (e). Even if the elastic sheet 20 is destroyed into fragments by numerous penetrations of the needles and threads, it is disposed between the sheets 30 and 35 and is therefore easily removed.

Finally, embroidery 40 having a pile structure is completed in step (f).

The method according to the second embodiment has advantages in that only one cutting step (d) is required, and a general embroidering machine is used. Further, the use of the lower sheet 35 may accommodate removal of the fragments of the elastic sheet 200 to enhance productivity of embroidery.

Figure 3F:
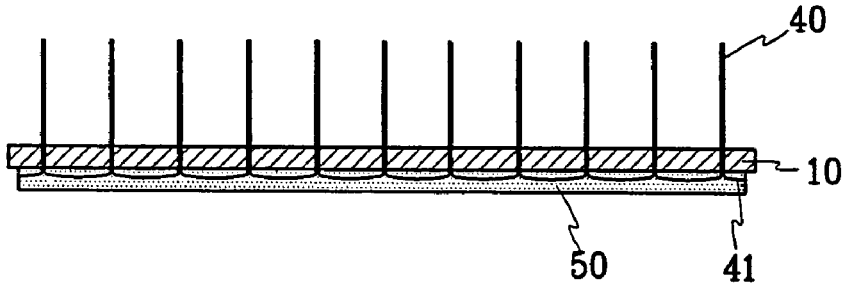
Figure 3G:
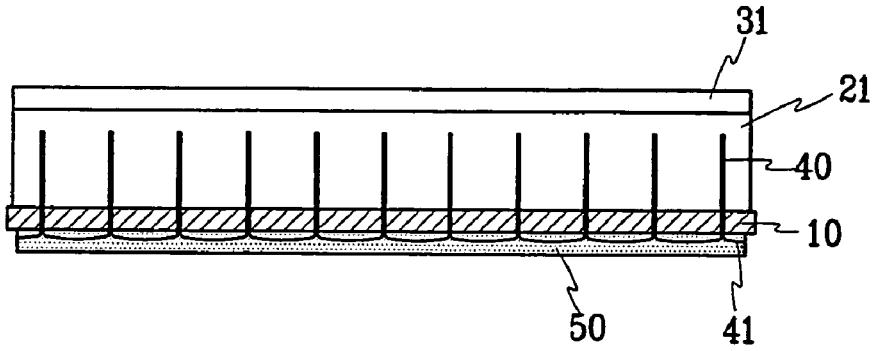
Figure 3H:
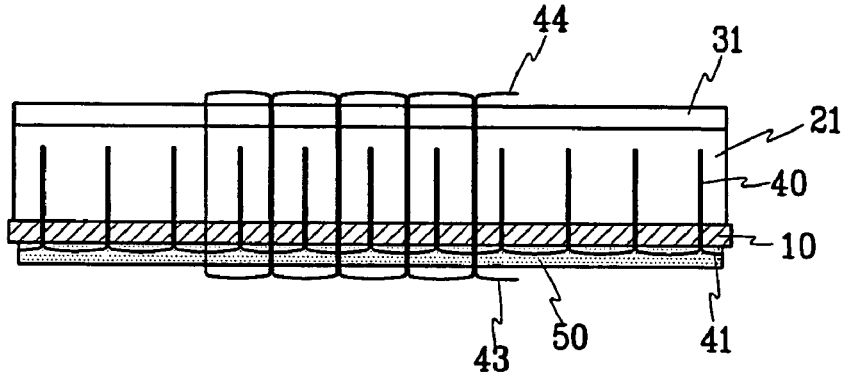
Figure 3I:
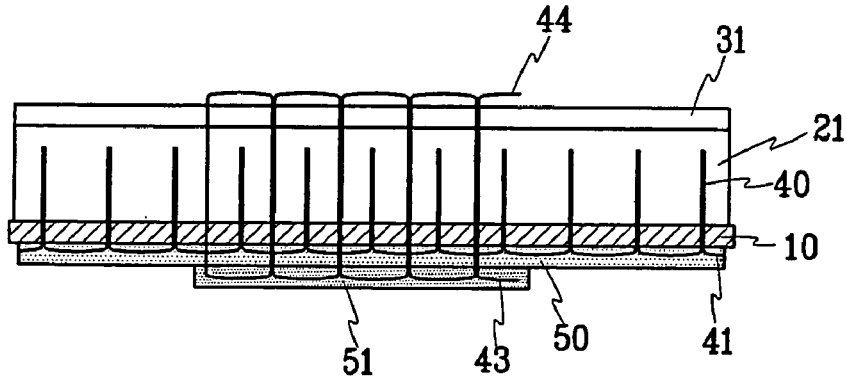
Figure 3J:
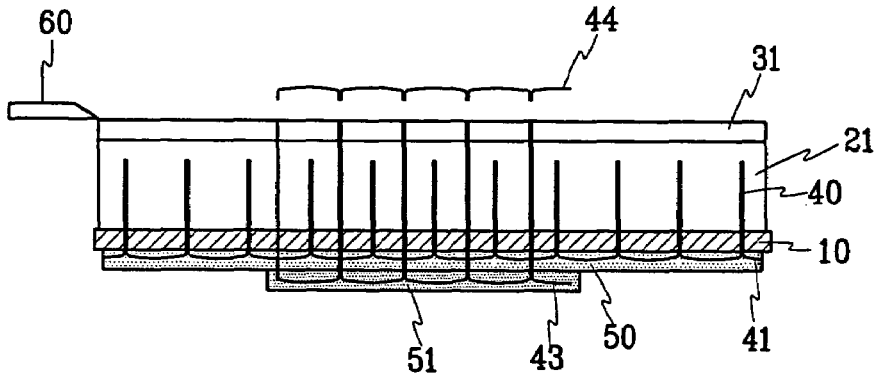
Figure 3K:
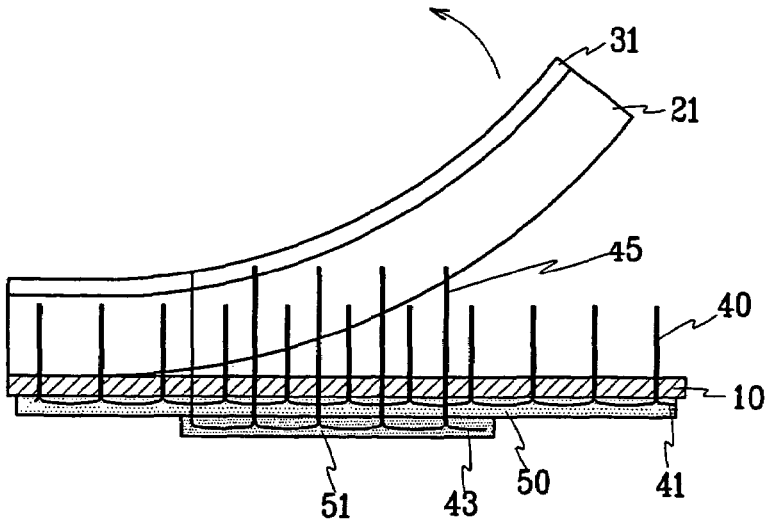
Figure 3I:
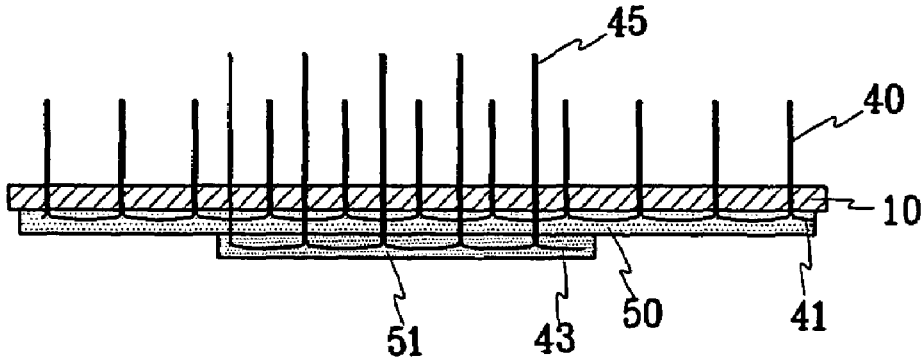
Figure 4A:
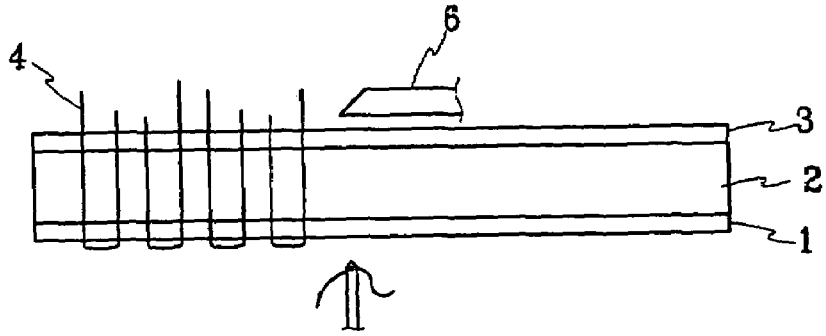
FIG. 4a (Prior Art)
FIG. 4*a*-4*e* illustrate steps of a conventional manufacturing method of embroidery having a pile structure.
Figure 4B:
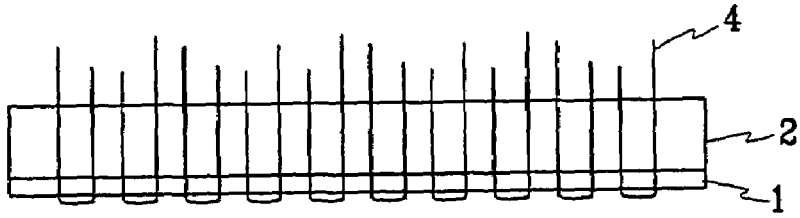
FIG. 4b (Prior Art)
Figure 4C:
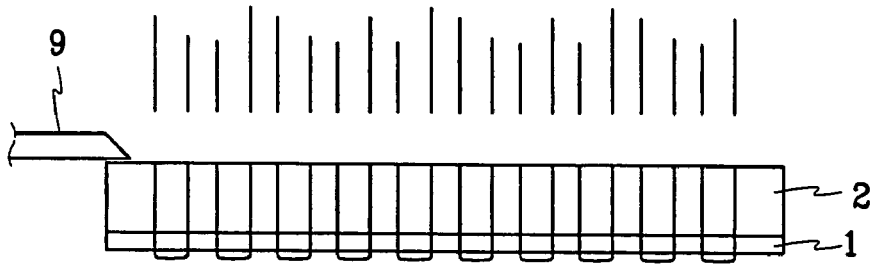
FIG. 4c (Prior Art)
Figure 4D:
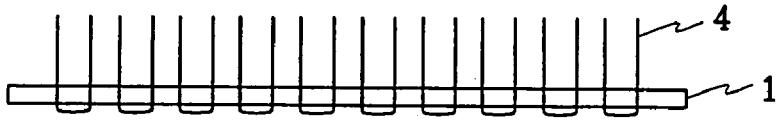
FIG. 4d (Prior Art)
Figure 4E:
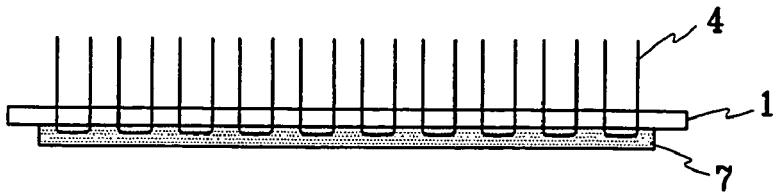
FIG. 4e (Prior Art)

Referring now to FIG. 3, a third embodiment of the present invention will be described. An embroidery method having a pile structure according to the third embodiment is accomplished by repeating the method according to the first or second embodiment twice or more.

The method according to the third embodiment has the steps (a)-(f) of the first or second embodiment which is described referring to FIG. 1 or FIG. 2. Subsequently, the steps (g)-(l) as shown in FIG. 3 are performed. That is, the first embroidery 40 having the first pile structure is formed in step (f). Then, an elastic sheet 21 and an upper sheet 31 are placed on the base fabric 10 in which the embroidery 40 is formed in step (g). The elastic sheet 21 has a second predetermined thickness which is preferably thicker than the elastic sheet 20 in FIG. 1 or 2, allowing the resultant pile of a second embroidery to have a height which is different from that of the first embroidery. It should be noted that another lower sheet may be disposed between the elastic sheet 21 and the base fabric 10 in order to accommodate removal of the elastic sheet 21 and the upper sheet 31, although this is omitted in FIG. 3.

Next, the upper sheet 31, the elastic sheet 21, and the base fabric 10 are embroidered again in a predetermined pattern with an upper thread 44 and a bobbin thread 43 of the general embroidery machine in step (h). After the embroidering step (h), an adhesive 51 is again applied on the back surface of the base fabric 10 to fix the upper thread 44 in step (i). Then, the upper thread 44 is cut over the upper sheet 31 by the cutter 60 in step (j). A part of upper thread 44 and all the bobbin thread 43 are removed.

The elastic sheet 21 and the upper sheet 31 are removed in step (k), and then the second embroidery 45 having a second pile structure is formed in step (l).

The resultant embroidery has both the first embroidery 40 and the second embroidery 45 whose piles are different in height from each other. Since the manufacturing method of embroidery can be repeated in order to accomplish embroidery having a plurality of pile structures, the resultant embroidery may have various embroidering effects and improved aesthetics.

It should be noted that the method according to the first or second embodiment can be repeated three times or more, although the third embodiment is described to repeat the method twice.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A manufacturing method of embroidery having a pile structure, comprising:

(a) preparing a base fabric having a front surface and a back surface;

(b) providing a first elastic sheet having a first predetermined thickness on the front surface of the base fabric;

(c) providing an upper sheet on the elastic sheet;

(d) embroidering a predetermined pattern on the base fabric together with the elastic sheet and the upper sheet using a general embroidery machine, the upper sheet preventing needles and threads of the embroidery machine from destroying the elastic sheet during the embroidering;

(e) applying an adhesive over the back surface of the base fabric to fix the threads which lie on the back surface of the base fabric;

(f) cutting threads over the upper sheet;

(g) removing the elastic sheet and the upper sheet from the base fabric, thereby forming a first embroidery;

(h) providing a second elastic sheet having a second predetermined thickness on at least a part of the first embroidery; and (i) repeating the (c) providing to the (g) removing, thereby forming a second embroidery.

2. The method of claim 1, wherein the (i) repeating is performed one or more times.

3. The method of claim 1, wherein the first predetermined thickness of the first elastic sheet is different from the second predetermined thickness of the second elastic sheet.

4. The method of claim 1, further comprising:

providing a lower sheet between the front surface of the base fabric and the elastic sheet before the (d) embroidering, wherein the lower sheet accommodates removal of the elastic and the upper sheet and is removed together with the elastic sheet from the base fabric.

* * * * *